US011238779B1

(12) United States Patent
Maruyama et al.

(10) Patent No.: US 11,238,779 B1
(45) Date of Patent: Feb. 1, 2022

(54) DEVICE AND METHOD FOR CONTROLLING A DISPLAY PANEL

(71) Applicant: Synaptics Incorporated, San Jose, CA (US)

(72) Inventors: Atsushi Maruyama, Tokyo (JP); Goro Sakamaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/096,819

(22) Filed: Nov. 12, 2020

(51) Int. Cl.

| | |
|---|---|
| ***G09G 3/20*** | (2006.01) |
| ***G04G 7/00*** | (2006.01) |
| ***G09G 3/3225*** | (2016.01) |
| ***G09G 3/3266*** | (2016.01) |

(52) U.S. Cl.
CPC ..... *G09G 3/2096* (2013.01); *G09G 3/3225* (2013.01); *G09G 3/3266* (2013.01); *G09G 2310/08* (2013.01)

(58) Field of Classification Search
CPC . G09G 3/2096–32661; G09G 2310/08; G04G 7/026
See application file for complete search history.

(56) References Cited

U.S. PATENT DOCUMENTS

| | | | | |
|---|---|---|---|---|
| 2008/0303836 | A1* | 12/2008 | Ludden | G09G 3/2092 345/531 |
| 2015/0123963 | A1* | 5/2015 | Tsai | G09G 3/2096 345/213 |
| 2015/0325213 | A1* | 11/2015 | Lee | G09G 3/2096 345/213 |
| 2018/0061309 | A1* | 3/2018 | Bae | G04G 7/026 |
| 2019/0095033 | A1* | 3/2019 | Takeuchi | G09G 3/2092 |

* cited by examiner

*Primary Examiner* — Lin Li
(74) *Attorney, Agent, or Firm* — Ferguson Braswell Fraser Kubasta PC

(57) ABSTRACT

A display driver includes internal oscillator circuitry, timing controller circuitry, and panel interface circuitry. The internal oscillator circuitry is disposed internal to the display driver and configured to generate an internal oscillation signal. The timing controller circuitry is configured to generate a resultant sync signal using an external sync input received from an entity external to the display driver during a first period of a frame period. The timing controller circuitry is further configured to generate the resultant sync signal using the internal oscillation signal during a second period of the frame period, the second period following the first period. The panel interface circuitry is configured to generate, based on the resultant sync signal, an emission control signal that controls emission scan driver circuitry configured to drive a plurality of emission scan lines of a display panel.

20 Claims, 6 Drawing Sheets

Low Frame Rate Mode

DEVICE AND METHOD FOR CONTROLLING A DISPLAY PANEL

FIELD

The disclosed technology generally relates to a display driver, display device and method for controlling a display panel.

BACKGROUND

A display system configured to display an image on a display panel may consume considerable power to control or drive the display panel. There is a technical need for reducing power consumption used to control or drive the display panel in a display system.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes internal oscillator circuitry, timing controller circuitry, and panel interface circuitry. The internal oscillator circuitry is disposed internal to the display driver and configured to generate an internal oscillation signal. The timing controller circuitry is configured to generate a resultant sync signal using an external sync input received from an entity external to the display driver during a first period of a frame period. The timing controller circuitry is further configured to generate the resultant sync signal using the internal oscillation signal during a second period of the frame period, the second period following the first period. The panel interface circuitry is configured to generate, based on the resultant sync signal, an emission control signal that controls emission scan driver circuitry configured to drive a plurality of emission scan lines of a display panel.

In one or more embodiments, a display system is provided. The display system includes a display panel, a display driver, and a control device. The display panel includes a plurality of emission scan lines and emission scan driver circuitry configured to drive the plurality of emission scan lines. The display driver includes internal oscillator circuitry disposed internal to the display driver and configured to generate an internal oscillation signal. The control device configured to supply an external sync input during a first period of a frame period. The display driver is configured to generate a resultant sync signal using the external sync input received from the control device during the first period. The display driver is further configured to generate the resultant sync signal using the internal oscillation signal during a second period of the frame period, the second period following the first period. The display driver is further configured to generate, based on the resultant sync signal, an emission control signal that controls the emission scan driver circuitry.

In one or more embodiments, a method for driving a display panel is provided. The method includes generating an internal oscillation signal in a display driver. The method further includes supplying an external sync input from an entity to the display driver during a first period of a frame period, the entity being external to the display driver. The method further includes generating, by the display driver, a resultant sync signal using the external sync input during the first period and generating, by the display driver, the resultant sync signal using the internal oscillation signal during a second period of the frame period, the second period following the first period. The method further generating, based on the resultant sync signal, an emission control signal that controls emission scan driver circuitry configured to drive a plurality of emission scan lines of a display panel.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
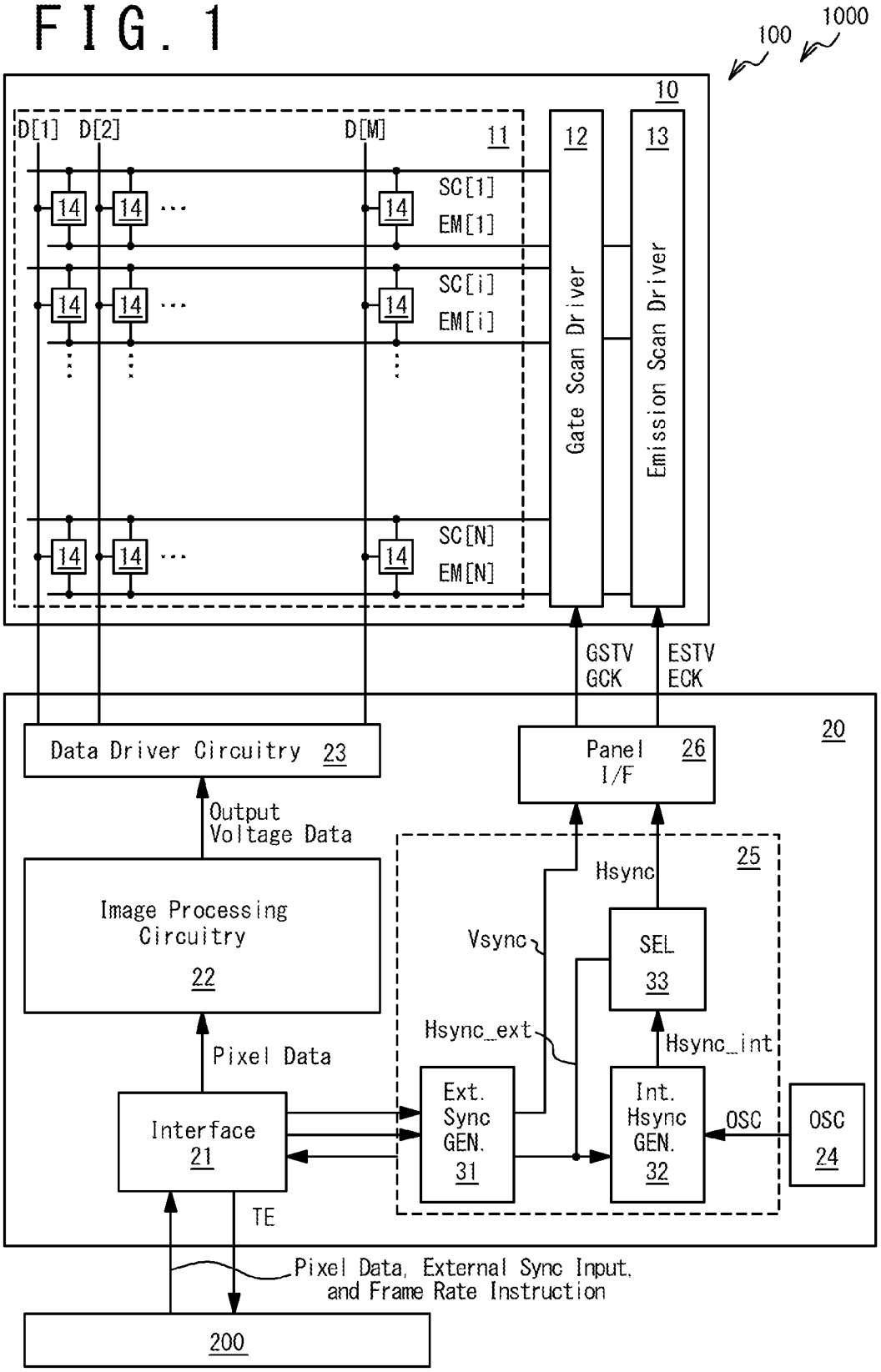
FIG. 1 illustrates an example configuration of a display system, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Controlling or driving a display panel may require considerable power, and therefore power consumption reduction is one of issues with display systems configured to display an image on a display panel.

One approach to reduce power consumption of a display system is to reduce the frequency of updating pixel circuits disposed in the display panel. Updating the pixel circuits less frequently effectively reduces the power consumption. The frequency of updating pixel circuits of a display panel may be measured as a frame rate. A display system may be configured such that the frame rate is variable, and the frame rate may be reduced when power consumption reduction is requested.

One issue with power consumption reduction of a display system is that some sort of display panel that incorporate pixel circuits configured to emit light may be configured to continuously receive control signals to keep the image displayed on the display panel. More specifically, a display panel may include multiple emission scan lines configured to control light emission from pixel circuits and emission scan driver circuitry configured to drive the emission scan lines.

Display panels thus configured, such as organic light emitting diode (OLED) display panels, micro light emitting diode (LED) display panels, and other self-luminous display panels, may be configured to continuously receive one or more emission control signals to control the emission scan driver circuitry. Generation of the emission control signals may need a timing reference. The display system may be configured to continuously supply a sync input as the timing reference to a display driver that drives the display panel. Continuously supplying the sync input to the display driver may, however, increase power consumption of the display system.

The present disclosure provides various techniques for reducing power consumption of a display system configured to display an image on a display panel that includes a plurality of emission scan lines and emission scan driver circuitry configured to drive the plurality of emission scan lines. In one or more embodiments, a display system includes a display panel, a display driver, and a control device. The display panel includes emission scan lines and emission scan driver circuitry configured to drive emission scan lines. The display driver includes internal oscillator circuitry disposed internal to the display driver and configured to generate an internal oscillation signal. The control device configured to supply an external sync input during a first period of a frame period. The display driver is configured to generate a resultant sync signal using the external sync input received from the control device during the first period. The display driver is further configured to generate the resultant sync signal using the internal oscillation signal during a second period of the frame period, the second period following the first period. The display driver is further configured to generate, based on the resultant sync signal, an emission control signal that controls the emission scan driver circuitry. By using the internal oscillator circuitry, it is possible to mitigate, if not completely eliminate, the need of supplying the external sync input from the control device to the display driver during at least part of the second period, effectively reducing the power consumption of the control device.

FIG. 1 illustrates an example configuration of a display system 1000, according to one or more embodiments. In the illustrated embodiment, a display system 1000 includes a display module 100 and a control device 200 that is an entity disposed external to the display module 100. Examples of the control device 200 include a host, an application processor, a CPU (central processing unit), and other types of processors.

The display module 100 includes a display panel 10 and a display driver 20. The display panel 10 may include a self-luminous display panel, such as an organic light emitting diode (OLED) display panel and a micro light emitting diode (LED) display panel. The display driver 20 is configured to display a desired image under control of the control device 200.

In the illustrated embodiment, the display panel 10 includes a display area 11, gate scan driver circuitry 12, and emission scan driver circuitry 13. In the illustrated embodiment, the display area 11 includes pixel circuits 14, M data lines D [1] to D [M], N gate scan lines SC [1] to SC [N], and N emission scan lines EM [1] to EM [N]. Each pixel circuit 14 is coupled to a corresponding gate scan line SC, emission scan line EM, and data line D.

The pixel circuits 14 are each configured to be programmed or updated with an output voltage received from the display driver 20. In one or more embodiments, programming or updating a pixel circuit 14 connected to the gate scan line SC [i], the emission scan line EM [i], and the data line D [j] may be achieved by asserting the gate scan line SC [i] in a state in which the emission scan line EM [i] is deasserted and the gamma voltage is supplied to the data line D [j]. The pixel circuits 14 are each further configured to emit light with a luminance level corresponding to the output voltage from the display driver 20. The light emission from the pixel circuits 14 is controlled by the emission scan lines EM [1] to EM [N]. The pixel circuits 14 connected to the emission scan line EM [i] are configured to emit light when the emission scan line EM [i] is asserted, not emitting light when deasserted.

The gate scan driver circuitry 12 is configured to scan (e.g., sequentially assert) the gate scan lines SC [1] to SC [N] to select pixel circuits 14 to be programmed or updated. The gate scan driver circuitry 12 is configured to assert the gate scan line SC [i] when pixel circuits 14 connected to the gate scan line SC [i] are programmed or updated. The assertion and deassertion of the gate scan lines SC [1] to SC [N] may be controlled based on a gate start pulse signal GSTV in synchronization with a gate clock GCK, where the gate start pulse signal GSTV and the gate clock GCK are received from the display driver 20. The gate clock GCK may comprise a multiphase (e.g., two-phase) clock signal. The gate start pulse signal GSTV controls the start timing of the scanning of the gate scan lines SC [1] to SC [N].

The emission scan driver circuitry 13 is configured to scan the emission scan lines EM [1] to EM [N] to control light emission from the pixel circuits 14 connected to the emission scan lines EM [1] to EM [N]. The emission scan driver circuitry 13 is configured to receive one or more emission control signals that control the operation of the emission scan driver circuitry 13. In one or more embodiments, the emission control signals include an emission clock ECK and an emission start pulse signal ESTV. In displaying an image, selected ones of the emission scan lines EM [1] to EM [N] are asserted to allow the pixel circuits 14 connected thereto to emit light, and the selection of the asserted emission scan lines EM is successively shifted over the array of the emission scan lines EM in synchronization with the emission clock ECK received from the display driver 20. The emission clock ECK may comprise a multiphase (e.g., two-phase) clock signal. The emission start pulse signal ESTV controls the start timing of the shift of the selection of the asserted emission scan lines EM. The emission start pulse signal ESTV may be generated as a pulse-width modulated signal and the display brightness level of the display module 100 is controlled by the duty ratio of the emission start pulse signal ESTV. The duty ratio of the emission start pulse signal ESTV may correspond to the ratio of a period during which the emission start pulse signal ESTV is asserted to one cycle period of the emission start pulse signal ESTV. In one or more embodiments, when the duty ratio of the emission start pulse signal ESTV increases, the ratio of the number of asserted emission scan lines EM to the total number of the emission scan lines EM increases, and the ratio of the pixel circuits 14 that emit light to the total number of pixel circuits 14 also increases, resulting in an increase in the display brightness level of the display module 100.

The display driver 20 is configured to receive pixel data and an external sync input from the control device 200 and control the display panel 10 based on the received pixel data and the external sync input. The pixel data may include graylevels defined for the pixel circuits 14. The external sync input is used as a timing reference to achieve timing synchronization among signals generated in the display module 100. In one or more embodiments, the external sync input includes vertical sync (Vsync) packets that define frame periods (or vertical sync periods) and horizontal sync (Hsync) packets that define horizontal sync periods. In other embodiments, the external sync input may include a vertical sync signal that defines frame periods and a horizontal sync signal that defines horizontal sync periods. The display driver 20 is further configured to receive a frame rate instruction that specifies a frame rate from the control device 200 and display images on the display panel 10 with the specified frame rate.

In the illustrated embodiment, the display driver 20 includes interface (I/F) circuitry 21, image processing circuitry 22, data driver circuitry 23, internal oscillation (OSC) circuitry 24, timing controller circuitry 25, and panel interface circuitry 26.

The interface circuitry 21 is configured to receive the pixel data, the external sync input, and the frame rate instruction from the control device 200. The interface circuitry 21 may be further configured to forward the pixel data to the image processing circuitry 22, and forward the external sync input and the frame rate instruction to the timing controller circuitry 25. In other embodiments, the interface circuitry 21 may be configured to process the pixel data and send the processed pixel data to the image processing circuitry 22. In one implementation, the interface circuitry 21 may be configured to send a tearing effect signal TE to the control device 200 under control of the timing controller circuitry 25. The tearing effect signal TE may be used to inform the control device 200 that the display driver 20 is ready to receive pixel data and request for starting transmitting the external sync input.

The image processing circuitry 22 is configured to process the pixel data received from the interface circuitry 21 to generate output voltage data. The output voltage data may include voltage values that specify voltage levels of the output voltages with which the respective pixel circuits 14 of the display panel 10 are to be programmed or updated. The processing performed by the image processing circuitry 22 may include color adjustment, image scaling, gamma transformation, subpixel rendering or other processes.

The data driver circuitry 23 is configured to generate output voltages provided to the respective pixel circuits 14 of the display panel 10 based on the output voltage data received from the image processing circuitry 22. The output voltages may have voltage levels specified by the output voltage data. The pixel circuits 14 are updated or programmed with the output voltage data provided thereto.

The internal oscillation circuitry 24 is configured to generate an internal oscillation signal OSC which may be used as an internal timing reference in the display driver 20. The internal oscillation circuitry 24 is disposed internal to the display driver 20. The internal oscillation signal OSC may be a periodical square wave signal. The internal oscillation circuitry 24 may include a phase locked loop (PLL) or a digital locked loop (DLL).

The timing controller circuitry 25 is configured to provide timing control for the display driver 20 based on the external sync input and the internal oscillation signal OSC. In the illustrated embodiment, the timing controller circuitry 25 is configured to generate one or more resultant sync signals based on the external sync input and the internal oscillation signal OSC. The timing controller circuitry 25 may be configured to generate the one or more resultant sync signals in synchronization with the external sync input while the external sync input is supplied to the display driver 20. The timing controller circuitry 25 may be further configured to generate the one or more resultant sync signals in synchronization with the internal oscillation signal OSC while the external sync input is not supplied to the display driver 20. In embodiments where the external sync input includes Hsync packets and Vsync packets, the resultant sync signals may include a resultant horizontal sync signal Hsync and a resultant vertical sync signal Vsync. The resultant horizontal sync signal Hsync may be generated in synchronization with the Hsync packets and the vertical horizontal sync signal Vsync may be generated in synchronization with the Vsync packets.

The panel interface circuitry 26 is configured to generate and supply the gate start pulse signal GSTV, the gate clock GCK, the emission start pulse signal ESTV, and the emission clock ECK in synchronization with the one or more resultant sync signals received from the timing controller circuitry 25. The emission start pulse signal ESTV may be generated through pulse width modulation (PWM) in synchronization with the one or more resultant sync signals. In embodiments where the one or more resultant sync signals include the resultant horizontal sync signal Hsync and the resultant vertical sync signal Vsync, the panel interface circuitry 26 may be configured to generate the gate start pulse signal GSTV, the gate clock GCK, the emission start pulse signal ESTV, and the emission clock ECK in synchronization with the resultant horizontal sync signal Hsync and the resultant vertical sync signal Vsync. The emission start pulse signal ESTV may be generated through PWM synchronous with the resultant horizontal sync signal Hsync. The gate start pulse signal GSTV and the gate clock GCK are provided to the gate scan driver circuitry 12, and the emission start pulse signal ESTV and the emission clock ECK are provided to the emission scan driver circuitry 13.

In the illustrated embodiment, the timing controller circuitry 25 include an external sync signal generator 31, an internal horizontal sync signal generator 32, and a selector 33. The external sync signal generator 31 is configured to generate an external horizontal sync signal Hsync_ext using the external sync input received from the control device 200 as a timing reference. In embodiments where the external sync input includes Hsync packets, the external sync signal generator 31 may be configured to generate the external horizontal sync signal Hsync_ext in synchronization with the Hsync packets. The external sync signal generator 31 may be configured to not generate the external horizontal sync signal Hsync_ext while no Hsync packets (or the external sync input) are supplied from the control device 200. The external sync signal generator 31 may be further configured to generate the resultant vertical sync signal Vsync in synchronization with the external sync input. In embodiments where the external sync input includes Vsync packets, the external sync signal generator 31 may be configured to generate the resultant vertical sync signal Vsync in synchronization with the Vsync packets.

The internal horizontal sync signal generator 32 is configured to generate an internal horizontal sync signal Hsync_int using the internal oscillation signal OSC received from the internal oscillator circuitry 24 as a timing reference. The internal horizontal sync signal generator 32 is configured to generate the internal horizontal sync signal Hsync_int independently of the external sync input (which may include the Hsync packets). In some embodiments, the internal horizontal sync signal generator 32 may be configured to adjust the phase of the internal horizontal sync signal Hsync_int so that the internal horizontal sync signal Hsync_int is synchronous with the external horizontal sync signal Hsync_ext while the external horizontal sync signal Hsync_ext is generated using the external sync input. This allows the internal horizontal sync signal generator 32 to synchronize the internal horizontal sync signal Hsync_int with the external horizontal sync signal Hsync_ext while the external horizontal sync signal Hsync_ext is generated in synchronization with the external sync input.

The selector 33 is configured to select the resultant horizontal sync signal Hsync between the external horizontal sync signal Hsync_ext and the internal horizontal sync signal Hsync_int. The resultant horizontal sync signal Hsync is provided to the panel interface circuitry 26.

Figure 2:
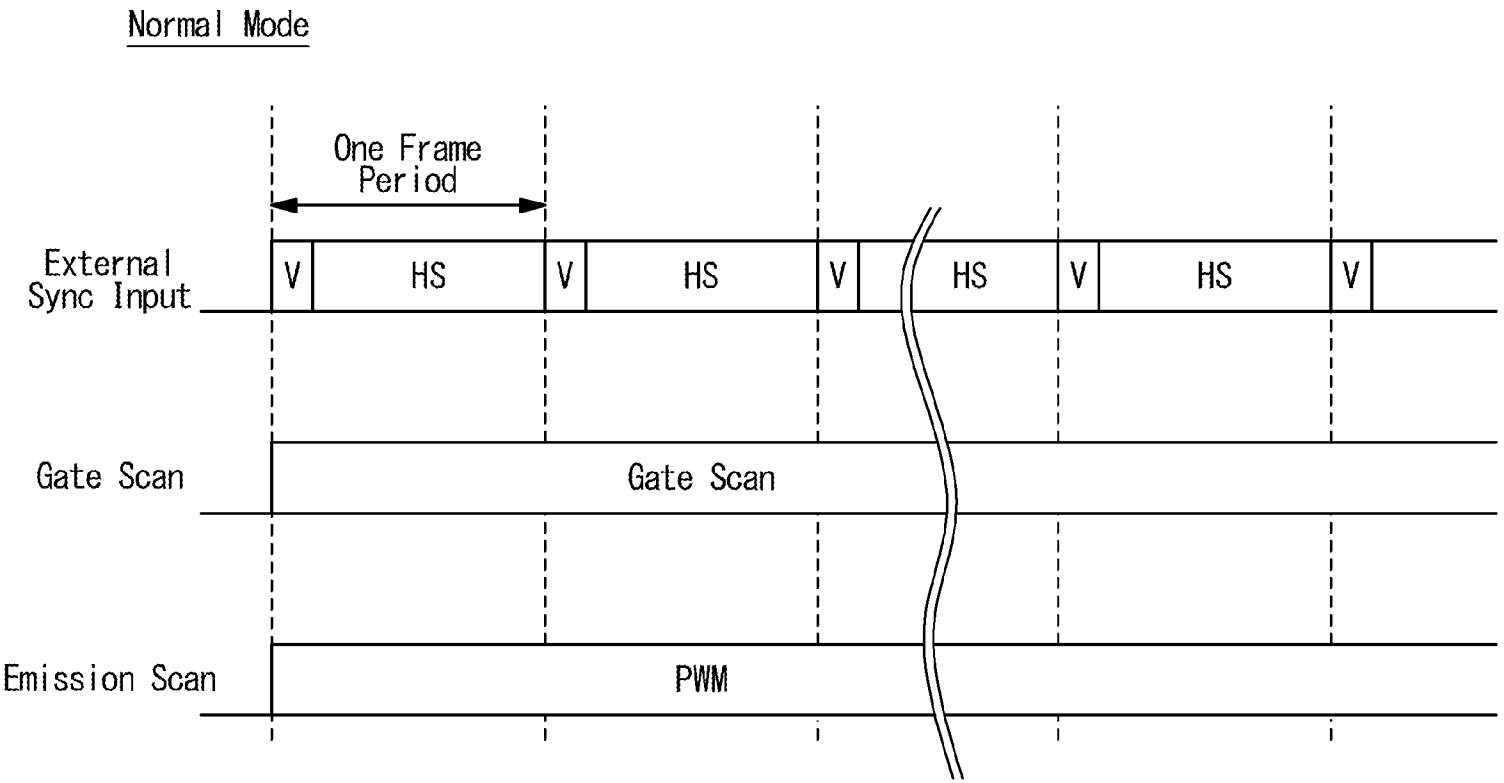
FIG. 2 illustrates an example operation of a display system in a normal mode, according to one or more embodiments.
Figure 3:
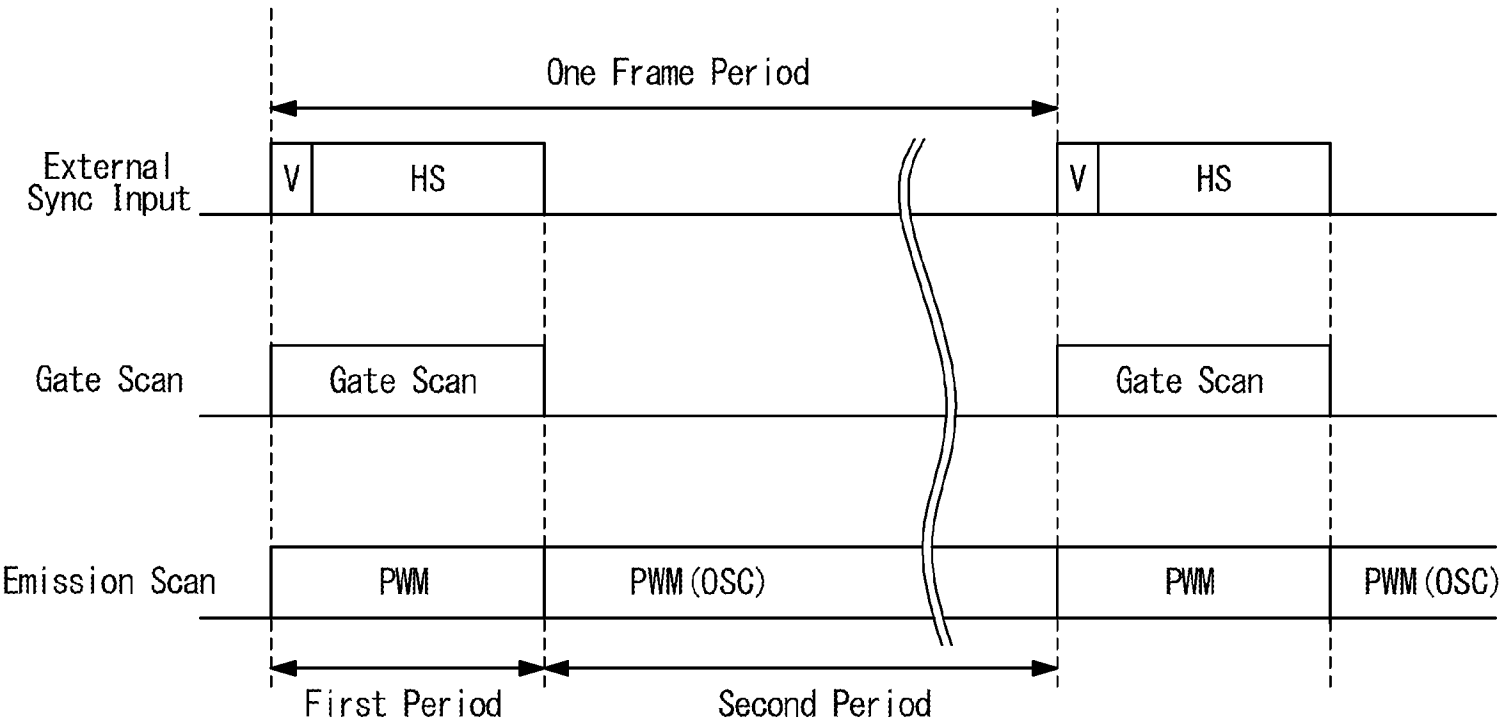
FIG. 3 illustrates an example operation of the display system in a low frame rate mode, according to one or more embodiments.

In one or more embodiments, the display system 1000 illustrated in FIG. 1 have two modes: a normal mode (or a first mode) and a low frame rate mode (or a second mode). FIG. 2 illustrates an example operation of the display system 1000 in the normal mode, and FIG. 3 illustrates an example operation of the display system 1000 in the low frame rate mode. The frame rate in the low frame rate mode is lower than that in the normal mode. Being in the lower than the normal mode leads to that the length of each frame period in the low frame rate mode being longer than that of each frame period in the normal mode. In one implementation, the control device 200 may be configured to specify the frame rate of the display module 100 and select the operation mode between the normal mode and the low frame rate mode, depending on the specified frame rate. The control device 200 may be configured to generate a frame rate instruction that indicates the determined frame rate and/or the selected operation mode and provide the frame rate instruction to the display driver 20.

In the normal mode, as illustrated in FIG. 2, the control device 200 continuously supplies the external sync input (which may include Vsync packets and Hsync packets), and the timing controller circuitry 25 continuously generates the resultant sync signals (which may include the resultant vertical sync signal Vsync and the resultant horizontal sync signal Hsync) using the external sync input. In FIG. 2 (and FIG. 3), "V" denotes a Vsync packet, and "HS" denotes Hsync packets successively supplied to the display driver 20. The panel interface circuitry 26 generates the gate start pulse signal GSTV, the gate clock GCK, the emission start pulse signal ESTV, and the emission clock ECK using the resultant sync signals received from the timing controller circuitry 25. The emission start pulse signal ESTV may be generated through PWM in synchronization with the resultant sync signals, which is generated using the external sync input. The gate scan driver circuitry 12 continuously scans the gate scan lines SC [1] to SC [N] in response to the gate start pulse signal GSTV and the gate clock GCK, while the emission scan driver circuitry 13 continuously scans the emission scan lines EM [1] to EM [N] in response to the emission start pulse signal ESTV and the emission clock ECK.

In the low frame rate mode, as illustrated in FIG. 3, the control device 200 is configured to not supply the external sync input after scanning of the gate scan lines SC [1] to SC [N] is completed in each frame period. By not supplying the external sync input, the power consumption of the control device 200 is effectively reduced. In the illustrated embodiment, the control device 200 is configured to supply the external sync input during a first period of each frame period and not supply the external sync input during a second period of each frame period, where the second period follows the first period. The gate scan driver circuitry 12 completes the scanning of the gate scan lines SC [1] to SC [N] in the first period, and does not scan the gate scan lines SC [1] to SC [N] during the second period. In the meantime, the emission scan driver circuitry 13 continues to scan the emission scan lines EM [1] to EM [N] to keep the image being displayed on the display panel 10 during the second period.

Since the external sync input is not supplied to the display driver 20 during the second period, the timing controller circuitry 25 is configured to generate and supply one or more of the resultant sync signals using the internal oscillation signal OSC to the panel interface circuitry 26 during the second period, and the panel interface circuitry 26 is configured to generate the emission start pulse signal ESTV and the emission clock ECK using the resultant sync signals. In one or more embodiments, the timing controller circuitry 25 generates the internal horizontal sync signal Hsync_int using the internal oscillation signal OSC and the selector 33 selects the internal horizontal sync signal Hsync_int, which is generated using the internal oscillation signal OSC, as the resultant horizontal sync signal Hsync during the second period. The panel interface circuitry 26 generates the emission start pulse signal ESTV and the emission clock ECK using the resultant horizontal sync signal Hsync. The emission start pulse signal ESTV may be generated through PWM in synchronization with the resultant horizontal sync signal Hsync. The generation of the resultant horizontal sync signal Hsync using the internal oscillation signal OSC during the second period enables continuously displaying the image on the display panel 10 during the second period, while reducing the power consumption of the display system 1000 by not supplying the external sync input to the display driver 20.

Figure 4:
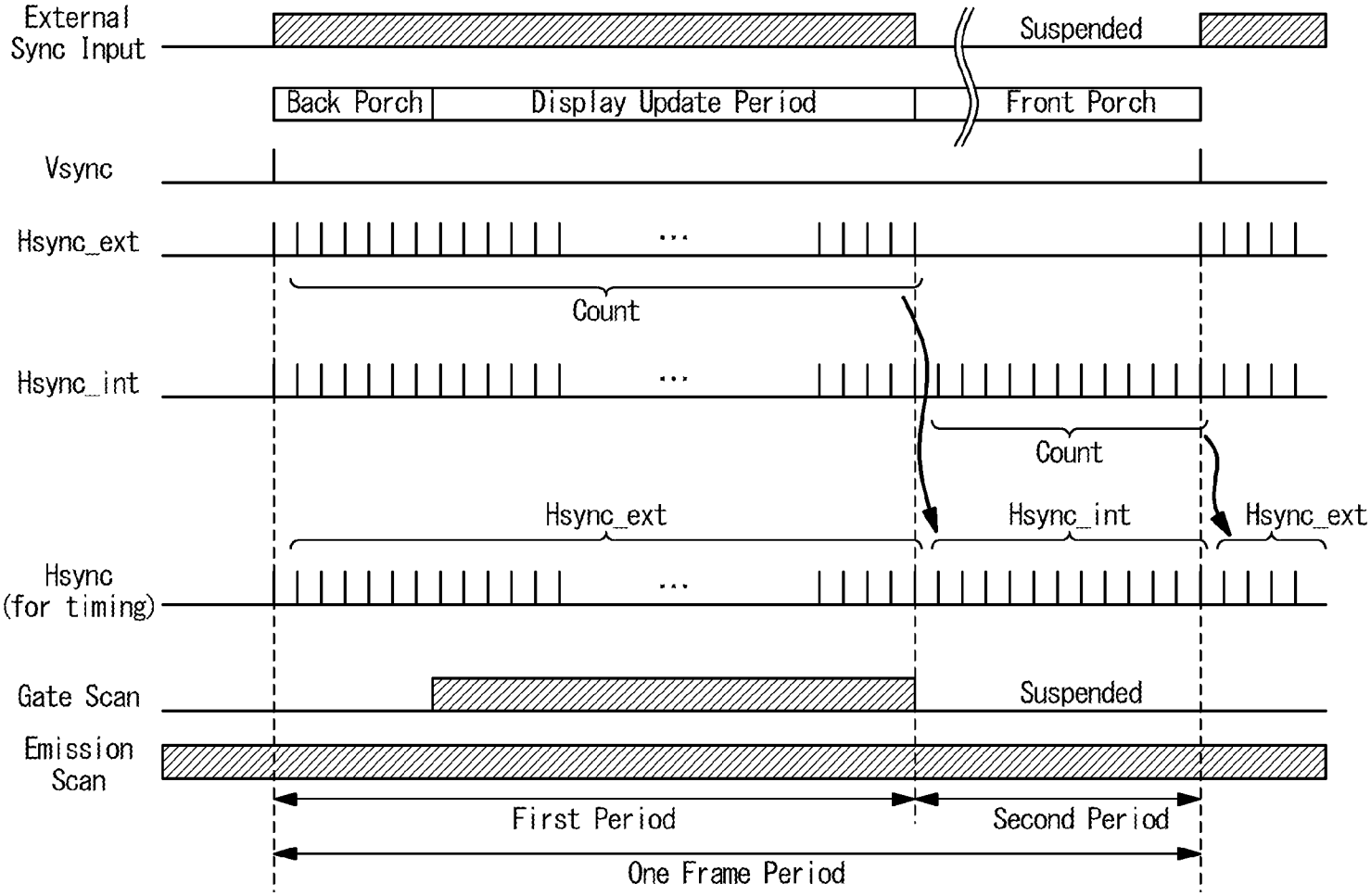
FIG. 4 illustrates an example operation of a display driver in a low frame rate mode, according to one or more embodiments.

FIG. 4 illustrates an example operation of the display driver 20 in the low frame rate mode, according one or more embodiments. In the illustrated embodiment, each frame period includes a back porch period, a display update period, and a front porch period. The pixel circuits 14 are updated with the output voltages received from the data driver circuitry 23 during the display update period.

The control device 200 continuously supplies the external sync input to the display driver 20 during a first period of each frame period. In the illustrated embodiment, the first period includes the back porch period and the display update period. The external sync signal generator 31 of the timing controller circuitry 25 generates the external horizontal sync signal Hsync_ext and the resultant vertical sync signal Vsync in response to the external sync input. In embodiments where the external sync input includes Vsync packets, the control device 200 transmits a Vsync packet to the display driver 20 at the beginning of each frame period, and the external sync signal generator 31 is configured to assert the resultant vertical sync signal Vsync at the beginning of each frame period in response to the Vsync packet. Each frame period may be defined as a period between two time points at which the resultant vertical sync signal Vsync is asserted. In embodiments where the external sync input includes Hsync packets, the external sync signal generator 31 is configured to assert the external horizontal sync signal Hsync_ext in response to the Hsync packets.

The selector 33 of the timing controller circuitry 25 selects the external horizontal sync signal Hsync_ext as the resultant horizontal sync signal Hsync during the first period, and the panel interface circuitry 26 generates the gate start pulse signal GSTV, the gate clock GCK, the emission start pulse signal ESTV, and the emission clock ECK in synchronization with the resultant horizontal sync signal Hsync. The gate scan driver circuitry 12 scans the gate scan line SC [1] to SC [N] during the display update period in response to the gate start pulse signal GSTV and the gate clock GCK to update or program the pixel circuits 14 of the display panel 10. The emission scan driver circuitry 13 scans the emission scan line EM [1] to EM [N] in response to the emission start pulse signal ESTV and the emission clock ECK to control light emission from the pixel circuits 14 during the back porch period and the display update period. The scanning of the gate scan line SC [1] to SC [N] and the update of the pixel circuits 14 are completed in the display update period of the first period.

To reduce the power consumption, the control device 200 does not supply the external sync input during a second period of each frame period, the second period following the first period. In the illustrated embodiment, the second period includes the front porch period. The length of the front porch period may be adjusted to achieve the frame rate specified by the control device 200. In one implementation, the frame rate is reduced by increasing the length of the front porch period.

The external horizontal sync signal Hsync_ext may be invalid during the second period as the timing controller circuitry 25 does not receive the external sync input. To address the invalidity, the timing controller circuitry 25 switches synchronization of the resultant horizontal sync signal Hsync from the external sync input to the internal oscillation signal OSC upon start of the second period. In one or more embodiments, this switching is achieved by causing the selector 33 to select the internal horizontal sync signal Hsync_int, which is generated using the internal oscillation signal OSC, as the resultant horizontal sync signal Hsync in place of the external horizontal sync signal Hsync_ext. The switching from the external sync input to the internal oscillation signal OSC may be based on a count of assertions of the external horizontal sync signal Hsync_ext. In one implementation, the selector 33 may switch the resultant horizontal sync signal Hsync from the external horizontal sync signal Hsync_ext to the internal horizontal sync signal Hsync_int in response to the count of the assertions of the external horizontal sync signal Hsync_ext reaching a predetermined number. The panel interface circuitry 26 continues to generate the emission start pulse signal ESTV and the emission clock ECK in synchronization with the resultant horizontal sync signal Hsync, and the emission scan driver circuitry 13 continues to scan the emission scan lines EM [1] to EM [N] using the emission start pulse signal ESTV and the emission clock ECK to continuously display the image on the display panel 10.

The control device 200 restarts supplying the external sync input to the display driver 20 at the beginning of the next frame period. The timing controller circuitry 25 asserts the resultant vertical sync signal Vsync at the beginning of the next frame period in response to the external sync input. In one implementation, the control device 200 transmits a Vsync packet to the display driver 20 at the beginning of the next frame period, and the timing controller circuitry 25 asserts the resultant vertical sync signal Vsync at the beginning of the next frame period in response to the Vsync packet. The control device 200 may then successively transmits Hsync packets to the display driver 20 during the first period (e.g., the back porch period and the display update period) of the next frame period.

The timing controller circuitry 25 switches synchronization of the resultant horizontal sync signal Hsync from the internal oscillation signal OSC to the external sync input at the start of the next frame period. In one or more embodiments, this switching is achieved by causing the selector 33 to select the external horizontal sync signal Hsync_ext as the resultant horizontal sync signal Hsync in place of the internal horizontal sync signal Hsync_int. The switching from the internal oscillation signal OSC to the external sync input may be based on a count of assertions of the internal horizontal sync signal Hsync_int. In one implementation, the selector 33 may switch the resultant horizontal sync signal Hsync from the internal horizontal sync signal Hsync_int to the external horizontal sync signal Hsync_ext in response to the count of the assertions of the internal horizontal sync signal Hsync_int reaching a predetermined number.

Since the external horizontal sync signal Hsync_ext and the internal horizontal sync signal Hsync_int are generated using different timing references, timing mismatching may exist between the external horizontal sync signal Hsync_ext and the internal horizontal sync signal Hsync_int. The timing mismatching may cause a disturbance on the displayed image when the resultant horizontal sync signal Hsync is switched between the external horizontal sync signal Hsync_ext and the internal horizontal sync signal Hsync_int. To mitigate the timing mismatching, in one or more embodiments, the internal horizontal sync signal Hsync_int may be synchronized with the external horizontal sync signal Hsync_ext while the external sync input is supplied to the display driver 20 from the control device 200.

Figure 5:
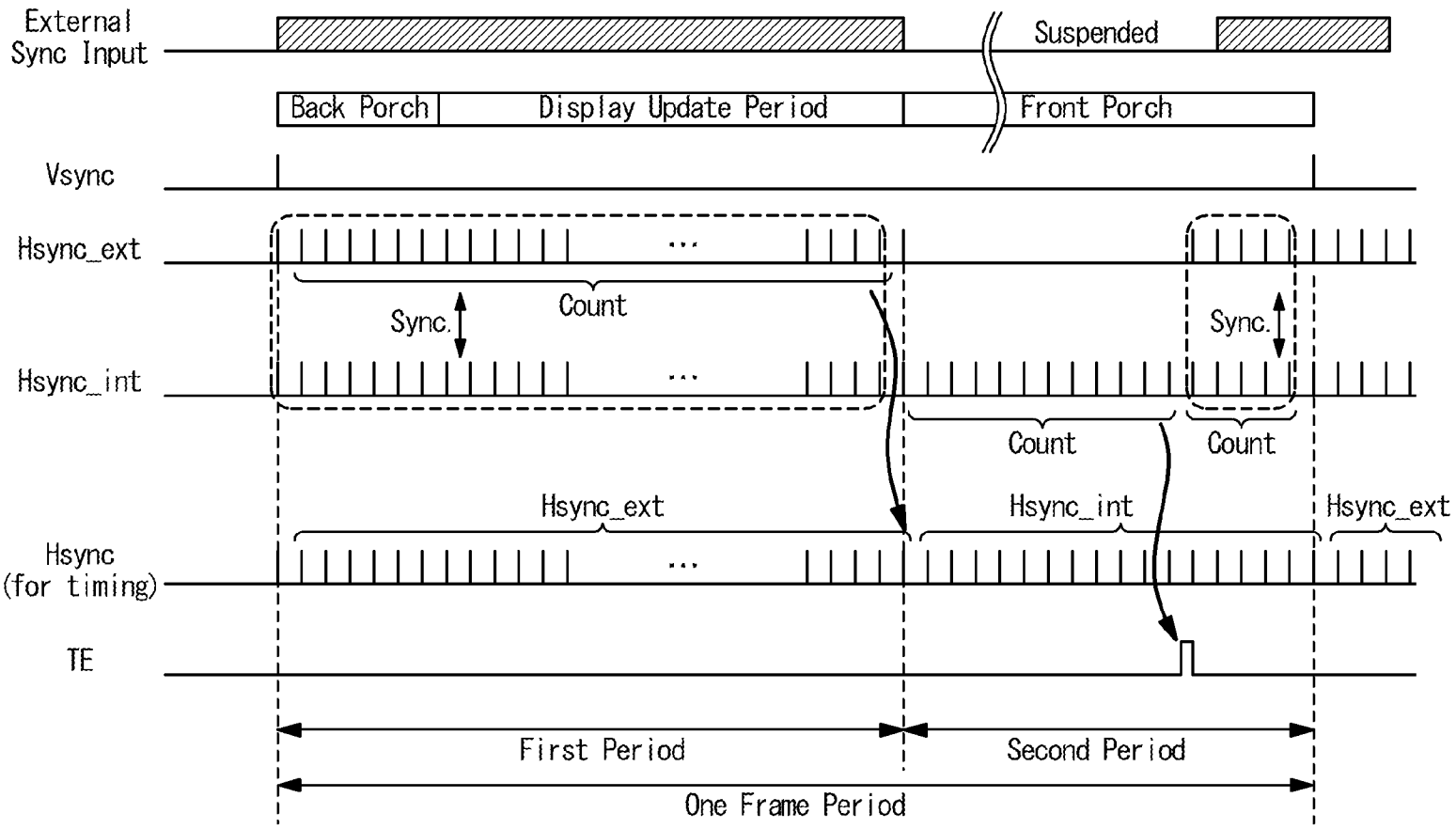
FIG. 5 illustrates an example operation of a display driver in a low frame rate mode, according to one or more embodiments.

FIG. 5 illustrates an example operation of the display driver 20 in the low frame rate mode, according to such embodiments. In the illustrated embodiment, the internal horizontal sync signal generator 32 adjusts the phase of the internal horizontal sync signal Hsync_int during at least part of the first period to synchronize the internal horizontal sync signal Hsync_int with the external horizontal sync signal Hsync_ext. The selector 33 then switches the resultant horizontal sync signal Hsync from the external horizontal sync signal Hsync_ext to the internal horizontal sync signal Hsync_int upon start of the second period. The phase adjustment of the of the internal horizontal sync signal Hsync_int effectively reduces the timing mismatching between the external horizontal sync signal Hsync_ext and the internal horizontal sync signal Hsync_int at the timing of the switching, mitigating an undesired effect of the switching on the displayed image. The switching from the external horizontal sync signal Hsync_ext to the internal horizontal sync signal Hsync_int may be based on a count of assertions of the external horizontal sync signal Hsync_ext. In one implementation, the selector 33 may switch the resultant horizontal sync signal Hsync from the external horizontal sync signal Hsync_ext to the internal horizontal sync signal Hsync_int in response to the count of the assertions of the external horizontal sync signal Hsync_ext reaching a predetermined number.

During the second period, the timing controller circuitry 25 selects the internal horizontal sync signal Hsync_int as the resultant horizontal sync signal Hsync, and the panel interface circuitry 26 continues to generate the emission start pulse signal ESTV and the emission clock ECK in synchronization with the resultant horizontal sync signal Hsync. This allows the emission scan driver circuitry 13 to continue to scan the emission scan lines EM [1] to EM [N] using the emission start pulse signal ESTV and the emission clock ECK and thereby continuously display the image on the display panel 10.

To reduce the power consumption, the control device 200 does not supply the external sync input during a former part of the second period. At the end of the former part of the second period, the interface circuitry 21 asserts the tearing effect signal TE under control of the timing controller circuitry 25. In response to the assertion of the tearing effect signal TE, the control device 200 restarts suppling the external sync input. The control device 200 continuously supplies the external sync input during a latter part of the second period, the latter part following the former part. The external sync signal generator 31 generates the external horizontal sync signal Hsync_ext in synchronization with the external sync input during the latter part of the second period. Meanwhile, the internal horizontal sync signal generator 32 adjusts the phase of the internal horizontal sync signal Hsync_int during the latter part of the second period to synchronize the internal horizontal sync signal Hsync_int with the external horizontal sync signal Hsync_ext.

At the start of the next frame period, the timing controller circuitry 25 switches synchronization of the resultant horizontal sync signal Hsync from the internal oscillation signal OSC to the external sync input. In one or more embodiments, this switching is achieved by causing the selector 33 to select the external horizontal sync signal Hsync_ext as the resultant horizontal sync signal Hsync in place of the internal horizontal sync signal Hsync_int. Since the internal horizontal sync signal Hsync_int is synchronized with the external horizontal sync signal Hsync_ext just before the switching, the operation illustrated in FIG. 5 effectively reduces the timing mismatching between the external horizontal sync signal Hsync_ext and the internal horizontal sync signal Hsync_int at the timing of the switching, mitigating an undesired effect of the switching on the displayed image. The switching from the internal horizontal sync signal Hsync_int to the external horizontal sync signal Hsync_ext may be based on a count of assertions of the internal horizontal sync signal Hsync_int during the latter part of the second period. In one implementation, the selector 33 may switch the resultant horizontal sync signal Hsync from the internal horizontal sync signal Hsync_int to the external horizontal sync signal Hsync_ext in response to the count of the assertions of the internal horizontal sync signal Hsync_int reaching a predetermined number during the latter part of the second period.

Figure 6:
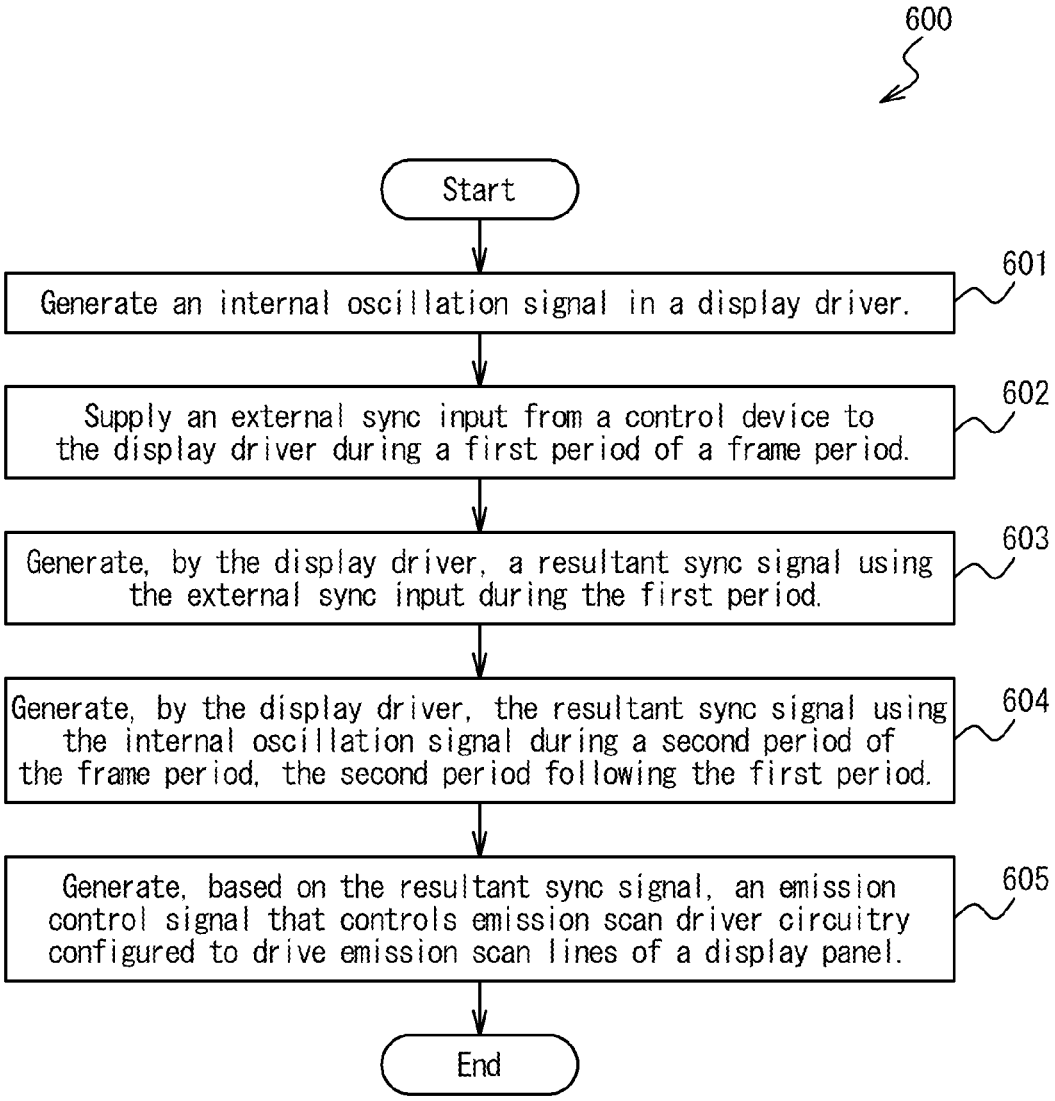
FIG. 6 illustrates an example method for controlling a display panel, according to one or more embodiments.

Method 600 of FIG. 6 illustrates steps for controlling a display panel (e.g., the display panel 10 illustrated in FIG. 1), according to one or more embodiments. It should be noted that the order of the steps may be altered from the order illustrated.

At step 601, an internal oscillation signal is generated in a display driver (e.g. the display driver 20). At step 602, an external sync input is supplied from a control device (e.g., the control device 200) to the display driver during a first period of a frame period. At step 603, a resultant sync signal is generated by the display driver using the external sync input during the first period. At step 604, the resultant sync signal is generated by the display driver using the internal oscillation signal during a second period of the frame period, the second period following the first period. At step 605, an emission control signal that controls emission scan driver circuitry (e.g., the emission scan driver circuitry 13) configured to drive emission scan lines of a display panel is generated based on the resultant sync signal.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

internal oscillator circuitry disposed internal to the display driver and configured to generate an internal oscillation signal;

timing controller circuitry configured to:

generate a resultant sync signal using an external sync input received from an entity external to the display driver during a first period of a frame period; and generate the resultant sync signal using the internal oscillation signal during a second period of the frame period, the second period following the first period; and panel interface circuitry configured to generate, based on the resultant sync signal, an emission control signal that controls emission scan driver circuitry configured to drive a plurality of emission scan lines of a display panel.

2. The display driver of claim 1, wherein the external sync input is not received by the display driver during at least part of the second period.

3. The display driver of claim 1, wherein the timing controller circuitry is further configured to switch synchronization of the resultant sync signal from the external sync input to the internal oscillation signal upon start of the second period.

4. The display driver of claim 1, wherein the resultant sync signal comprises a resultant horizontal sync signal that defines horizontal sync periods.

5. The display driver of claim 4, wherein the timing controller circuitry is further configured to:

generate an external horizontal sync signal based on the external sync input;

generate an internal horizontal sync signal based on the internal oscillation signal;

select the external horizontal sync signal as the resultant horizontal sync signal during the first period; and switch the resultant horizontal sync signal from the external horizontal sync signal to the internal horizontal sync signal upon start of the second period.

6. The display driver of claim 5, wherein switching the resultant horizontal sync signal from the external horizontal sync signal to the internal horizontal sync signal is based on a count of assertions of the external horizontal sync signal.

7. The display driver of claim 5, wherein the timing controller circuitry is further configured to synchronize the internal horizontal sync signal with the external horizontal sync signal during at least part of the first period.

8. The display driver of claim 5, wherein the timing controller circuitry is further configured to switch the resultant horizontal sync signal from the internal horizontal sync signal to the external horizontal sync signal upon start of a third period that follows the second period.

9. The display driver of claim 8, wherein switching the resultant horizontal sync signal from the internal horizontal sync signal to the external horizontal sync signal is based on a count of assertions of the internal horizontal sync signal.

10. The display driver of claim 9, wherein the second period comprises:

a former part during which the external sync input is not received by the display driver; and a latter part during which the external sync input is received by the display driver, the latter part following the former part, and wherein the timing controller circuitry is further configured to synchronize the internal horizontal sync signal with the external horizontal sync signal during the latter part of the second period.

11. The display driver of claim 1, wherein the emission control signal comprises an emission start pulse signal generated through pulse width modulation (PWM) in synchronization with the resultant sync signal.

12. A display system, comprising:

a display panel comprising:

a plurality of emission scan lines; and emission scan driver circuitry configured to drive the plurality of emission scan lines;

a display driver comprising internal oscillator circuitry disposed internal to the display driver and configured to generate an internal oscillation signal; and a control device configured to supply an external sync input during a first period of a frame period, wherein the display driver is configured to generate a resultant sync signal using the external sync input received from the control device during the first period; and generate the resultant sync signal using the internal oscillation signal during a second period of the frame period, the second period following the first period; and generate, based on the resultant sync signal, an emission control signal that controls the emission scan driver circuitry.

13. The display system of claim 12, wherein the control device is configured to not supply the external sync input to the display driver during at least part of the second period.

14. The display system of claim 12, wherein the display driver is further configured to switch synchronization of the resultant sync signal from the external sync input to the internal oscillation signal upon start of the second period.

15. The display system of claim 12, wherein the resultant sync signal comprises a resultant horizontal sync signal that defines horizontal sync periods.

16. The display system of claim 15, wherein the display driver is further configured to:

generate an external horizontal sync signal based on the external sync input;

generate an internal horizontal sync signal based on the internal oscillation signal;

select the external horizontal sync signal as the resultant horizontal sync signal during the first period; and switch the resultant horizontal sync signal from the external horizontal sync signal to the internal horizontal sync signal upon start of the second period.

17. The display system of claim 16, wherein switching the resultant horizontal sync signal from the external horizontal sync signal to the internal horizontal sync signal is based on a count of assertions of the external horizontal sync signal.

18. The display system of claim 16, wherein the display driver is further configured to synchronize the internal horizontal sync signal with the external horizontal sync signal during at least part of the first period.

19. A method, comprising:

generating an internal oscillation signal in a display driver;

supplying an external sync input from a control device to the display driver during a first period of a frame period, the control device being external to the display driver;

generating, by the display driver, a resultant sync signal using the external sync input during the first period;

generating, by the display driver, the resultant sync signal using the internal oscillation signal during a second period of the frame period, the second period following the first period; and generating, based on the resultant sync signal, an emission control signal that controls emission scan driver circuitry configured to drive a plurality of emission scan lines of a display panel.

20. The method of claim 19, wherein the resultant sync signal comprises a resultant horizontal sync signal that defines horizontal sync periods.

* * * * *